US008337035B2

(12) United States Patent
Lu

(10) Patent No.: US 8,337,035 B2
(45) Date of Patent: Dec. 25, 2012

(54) ILLUMINATING DEVICE FOR A WALKING STICK

(75) Inventor: Shin-Sheng Lu, Taichung (TW)

(73) Assignee: Xin-Chou Lai, Taichung (TW)

( * ) Notice: Subject to any disclaimer, the term of this patent is extended or adjusted under 35 U.S.C. 154(b) by 126 days.

(21) Appl. No.: 13/037,376

(22) Filed: Mar. 1, 2011

(65) Prior Publication Data

US 2012/0223645 A1 Sep. 6, 2012

(51) Int. Cl.
*A45B 3/02* (2006.01)

(52) U.S. Cl. ..... 362/102; 362/234

(58) Field of Classification Search ..... 362/102, 362/276; 135/16, 17, 65, 66, 910, 911
See application file for complete search history.

(56) References Cited

U.S. PATENT DOCUMENTS

| | | | | |
|---|---|---|---|---|
| 1,000,911 | A * | 8/1911 | Hoppenstand | 135/911 |
| 2,271,190 | A * | 1/1942 | Giaimo | 362/102 |
| 4,099,535 | A * | 7/1978 | Hubachek | 135/66 |
| 2006/0124158 | A1 * | 6/2006 | Lin et al. | 135/910 |
| 2008/0225513 | A1 * | 9/2008 | Durfee et al. | 362/102 |

FOREIGN PATENT DOCUMENTS

EP 114929 A1 * 8/1984

* cited by examiner

*Primary Examiner* — Y My Quach Lee

(57) ABSTRACT

An illuminating device for a walking stick includes a main body having a through hole defined in a top thereof for adapting to receive a bottom of a walking stick, such that the main body adapts to position on the walking stick. A plurality of light source is mounted on the main body for emitting light. A light shade sleeves on the main body and encloses the light sources. The light shade allows light to pass through. A power supply is mounted in the main body and is electrically connected with the light sources. When the light sources are supplied with electricity provided by the power supply to emit light, light emitted by the light sources is transmitted through the light shade for providing an illuminating effect.

7 Claims, 5 Drawing Sheets

ILLUMINATING DEVICE FOR A WALKING STICK

BACKGROUND OF THE INVENTION

1. Field of the Invention

The present invention relates to an illuminating device for a walking stick, and more particularly to an illuminating device mounted on a bottom of the walking stick for providing an illuminating effect.

2. Description of Related Art

A conventional lighting apparatus for a walking stick comprises a casing which is assembled within a T-shaped handle of a walking stick. The casing is a metal tube and receives at least one battery. An insulating film is disposed around an inner periphery of the casing. An insulating base is securely connected with a rear portion of the casing. A conducting head has a through hole centrally defined therein. The insulating base is mounted in the through hole of the conducting head. A first conducting plate is centrally connected with the insulating base and a spring abuts against the first conducting plate. A second conducting plate is annularly disposed between an outer periphery of the insulating base and the conducting head. A condensing member is screwed to a front portion of the casing and is assembled with the light shade. A circuit board is mounted in the light shade and has at least one light emitting diode (LED) disposed thereon. Accordingly, the at least one LED emits light from the casing to provide the walking stick a lighting effect.

However, the lighting apparatus is disposed on a top of the walking stick. When the lighting apparatus is operated to provide illumination, the step area which a user walks across does not cover within the illuminating area of the at least one LED. Therefore, the conventional lighting apparatus is not able to provide sufficient illumination when the user takes the walking stick and walks in a dark place. It is dangerous and inconvenient.

Although the flexible connecter assembly for track lighting device has a flexible and expandable member permitting the positioning of joined track sections at a variety of angles, such that the track lighting device is able to be mounted to different environments. However, the at least one lamp is screwed to the track sections. The at least one lamp is not easy to detach from the track sections for maintenance. Moreover the assembly of the flexible connecter assembly for track lighting device is not simple.

The present invention has arisen to mitigate and/or obviate the disadvantages of the conventional lighting apparatus for a walking stick.

SUMMARY OF THE INVENTION

The main objective of the present invention is to provide an improved illuminating device for a walking stick.

To achieve the objective, the illuminating device for a walking stick in accordance with the present invention includes a main body, a plurality of light source mounted on the main body for emitting light, a light shade which sleeves on the main body, and a power supply mounted in the main body and electrically connected with the light sources. The power supply is a plurality of batteries electrically connected with each other in series.

The main body comprises an upper member, a lower member, and an inner tube having two ends respectively connected with the upper member and the lower member. The upper member has a through hole axially defined in a top thereof for adapting to receive a bottom of a walking stick, such that the main body adapts to position on the walking stick. The lower member has a receiving chamber axially defined in a bottom thereof and extending therethrough for partially receiving the power supply. A cover is disposed in the bottom of the lower member for sealingly covering the receiving chamber. The lower member has a wear-resisting sleeve annularly disposed on an outer periphery thereof.

The main body comprises a control circuit electrically connected with the power supply and the light sources. The control circuit comprises an optoelectronic device, an oscillator, and a timer mounted thereon. The optoelectronic device may be a light dependent resistor, a photodiode, or a phototransistor.

The optoelectronic device adapts to detect a darkness/brightness in an environment to open/close the control circuit. An oscillation of the oscillator is sensed to control the control circuit when the walking stick is used. The timer is used to control an operating duration of the control circuit.

The control circuit comprises a first conducting member, a second conducting member, and a third conducting member mounted thereon. The second conducting member is electrically connected with the third conducting member. The first conducting member and the third conducting member are electrically connected with the power supply.

The light shade encloses the light sources and allows light to pass through. The light shade has two ends respectively connected with the upper member and the lower member. The light shade coaxially sleeves on the inner tube.

Therefore, the light sources are supplied with electricity provided by the power supply to emit light, and light emitted by the light sources is transmitted through the light shade for providing an illuminating effect.

Further benefits and advantages of the present invention will become apparent after a careful reading of the detailed description with appropriate reference to the accompanying drawings.

DETAILED DESCRIPTION OF THE INVENTION

Figure 1:
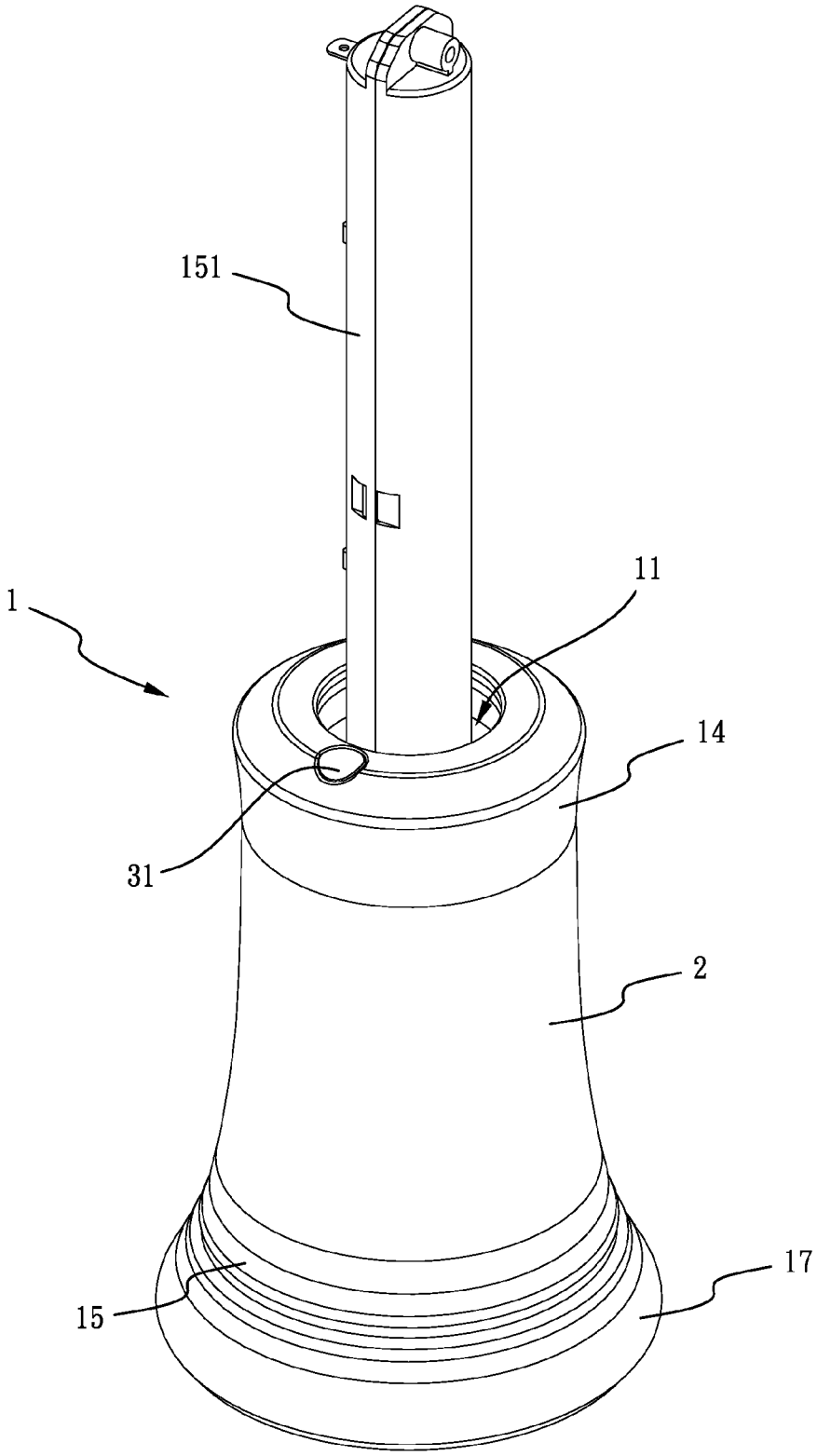
FIG. 1 is an assembled perspective view of a preferred embodiment of an illuminating device for a walking stick in accordance with the present invention.
Figure 2:
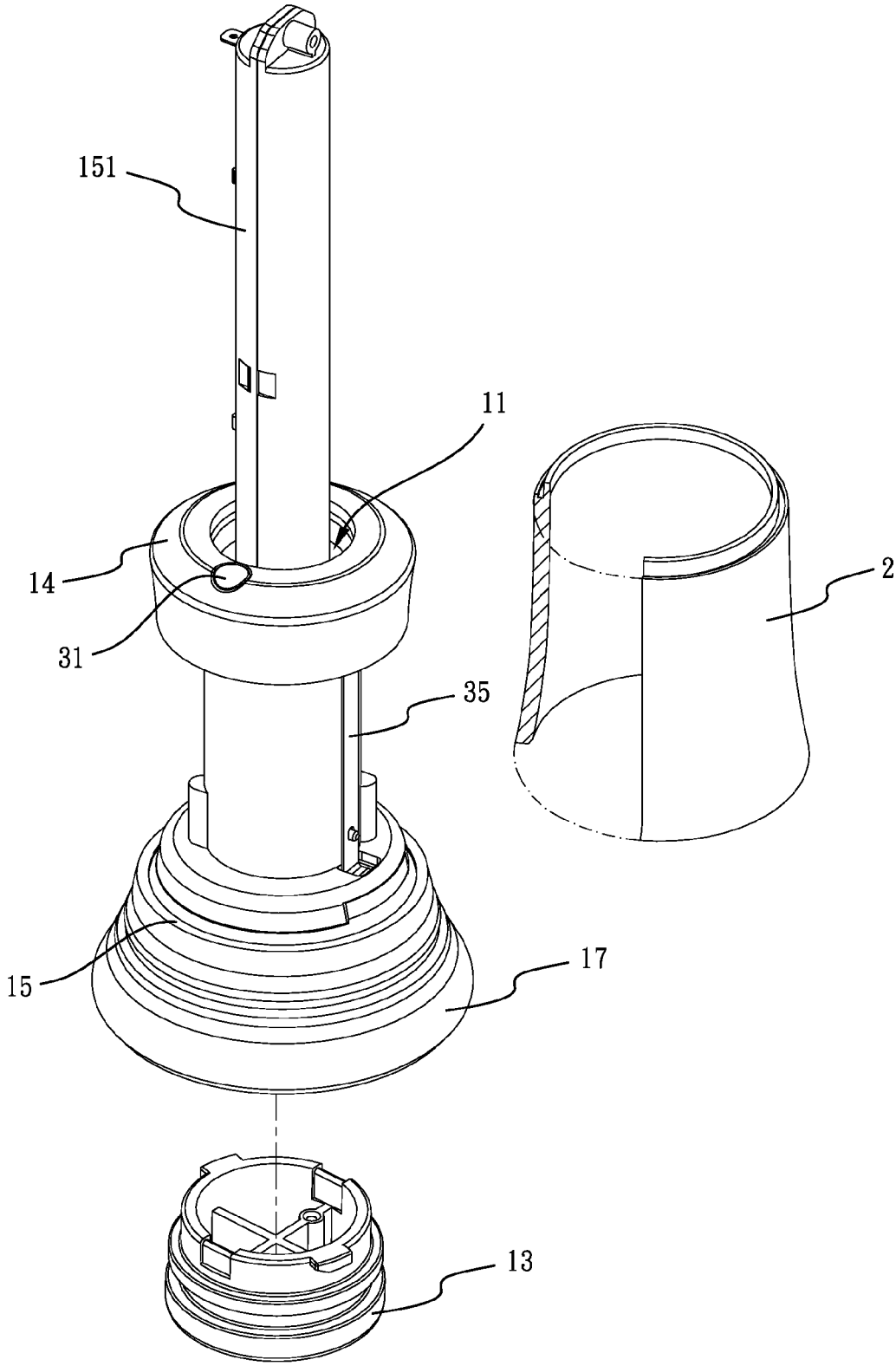
FIG. 2 is a partially exploded perspective view of the preferred embodiment of the illuminating device for a walking stick in accordance with the present invention.
Figure 3:
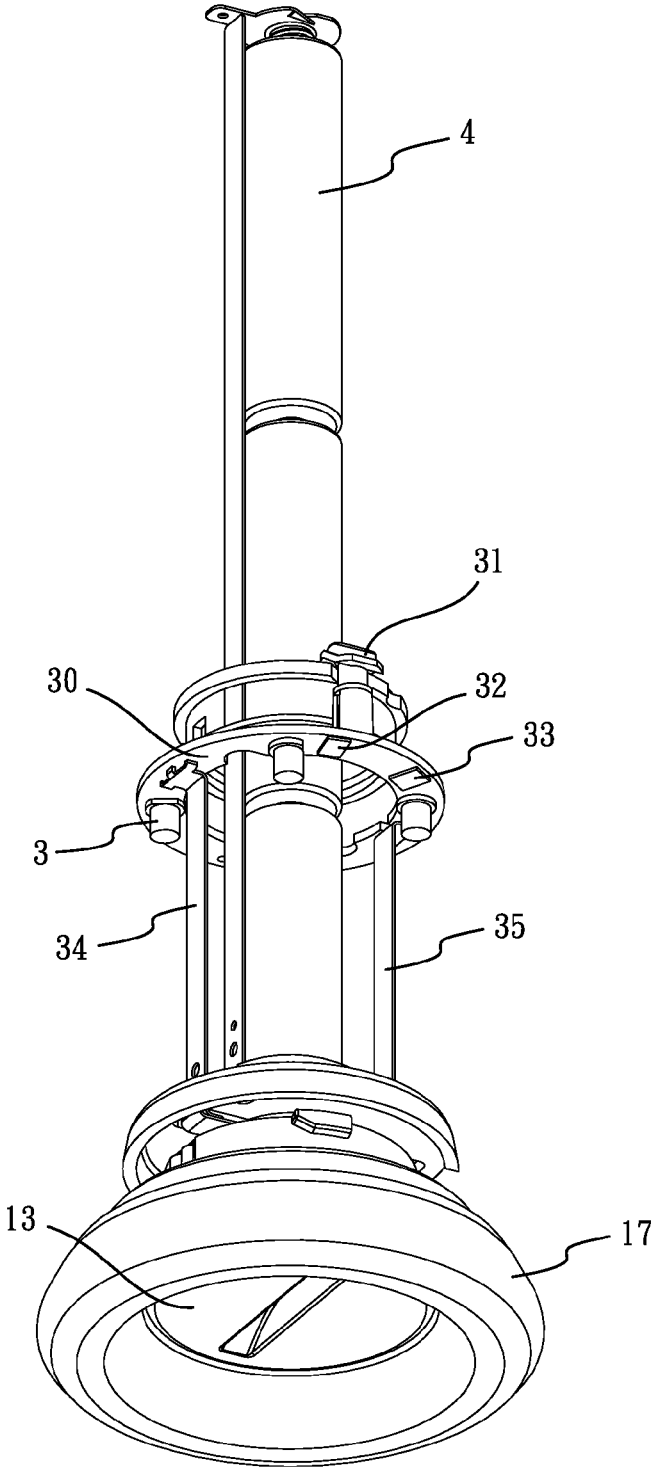
FIG. 3 is a partially assembled perspective view of the preferred embodiment of the illuminating device for a walking stick in accordance with the present invention.
Figure 4:
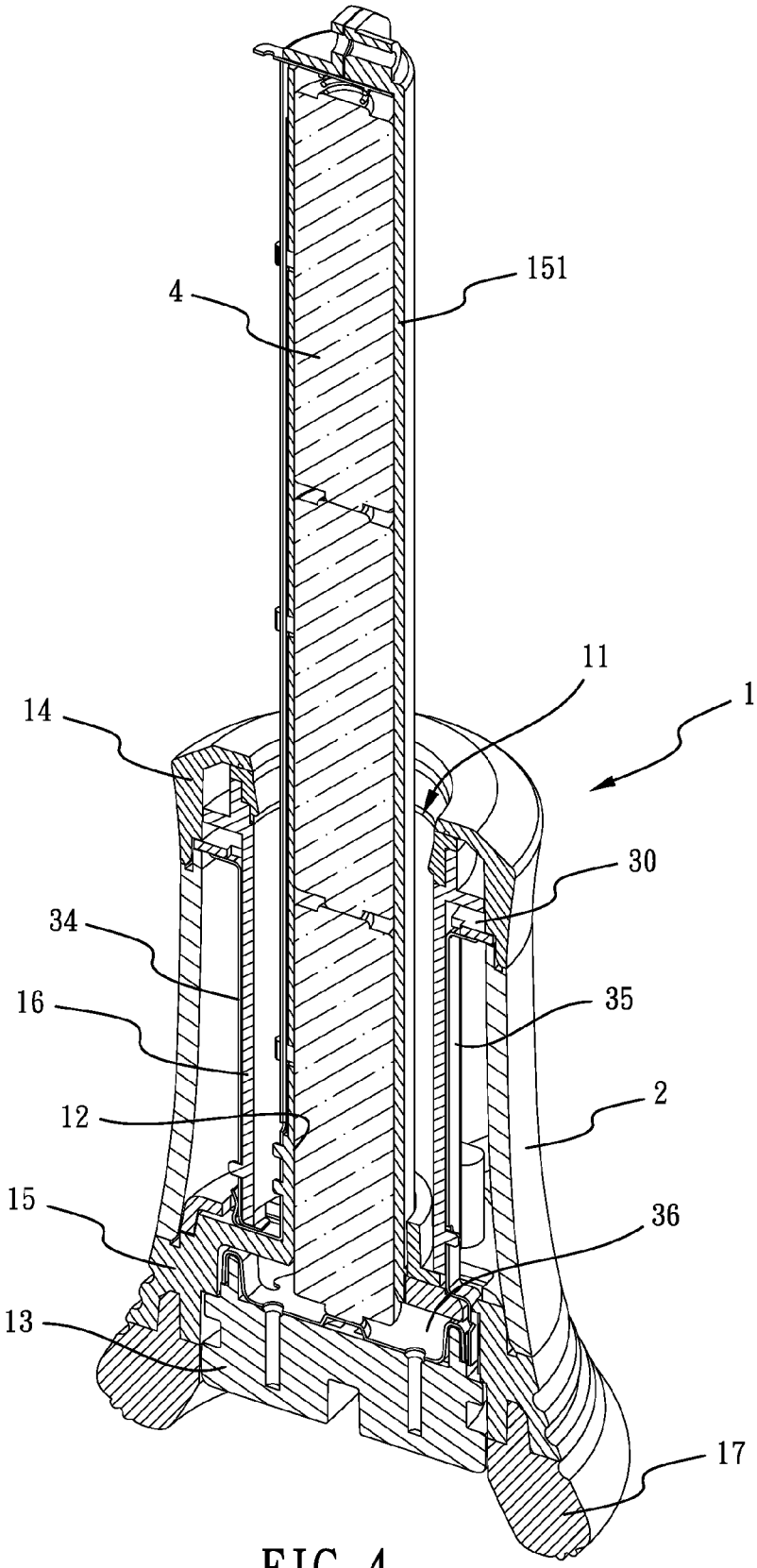
FIG. 4 is a cross-sectional perspective view of the preferred embodiment of the illuminating device for a walking stick in accordance with the present invention.
Figure 5:
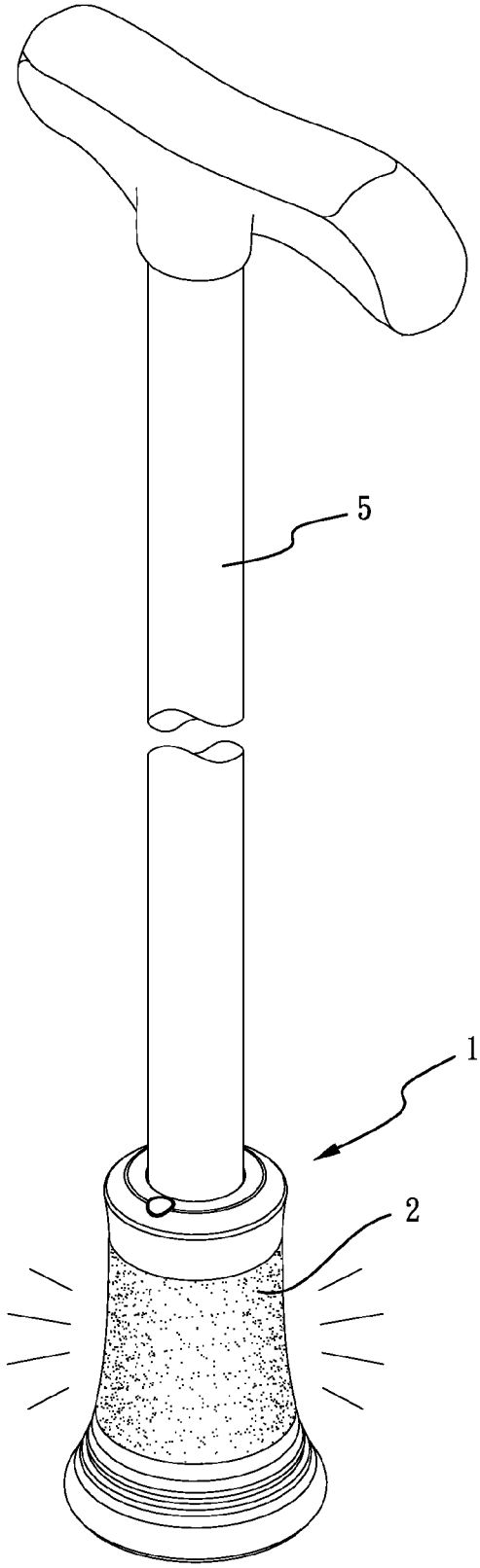
FIG. 5 is an operational perspective view of the preferred embodiment of the illuminating device for a walking stick in accordance with the present invention.

Referring to the drawings and initially to FIGS. 1-5, an illuminating device for a walking stick in accordance with a preferred embodiment of the present invention comprises a main body 1, a plurality of light source 3 mounted on the main body 1 for emitting light, a light shade 2 which sleeves on the main body 1, and a power supply 4 mounted in the main body 1 and electrically connected with the light sources 3. The power supply 4 is a plurality of batteries electrically connected with each other in series.

The main body 1 comprises an upper member 14, a lower member 15, and an inner tube 16 having two ends respectively connected with the upper member 14 and the lower member 15. The upper member 14 has a through hole 11 axially defined in a top thereof for adapting to receive a bottom of a walking stick 5, such that the main body 1 adapts to position on the walking stick 5. The lower member 15 has a receiving chamber 12 axially defined in a bottom thereof and extending therethrough. An extendable tube 151 axially passes through the through hole 11 and the inner tube 16 for receiving the batteries 4. A gap (not numbered) annularly defined between an outer periphery of the extendable tube 151 and the inner periphery of the inner tube 16. The receiving chamber 12 is axially defined in a lower end of the extendable tube 151. An upper end of the extendable tube 151 extends though the top of the upper member 14. A cover 13 is disposed in the bottom of the lower member 15 for sealingly covering a bottom of the receiving chamber 12. The batteries 4 are able to be replaced as the cover 13 is rotatably opened. The lower member 15 has a wear-resisting sleeve 17 annularly disposed on an outer periphery thereof.

The main body 1 comprises a control circuit 30 disposed on a bottom of the upper member 14 and electrically connected with the power supply 4 and the light sources 3. The control circuit 30 comprises an optoelectronic device 31, an oscillator 32, and a timer 33 mounted thereon. The optoelectronic device 31 may be a light dependent resistor, a photodiode, or a phototransistor. The optoelectronic device 31 adapts to detect a darkness/brightness in an environment to open/close the control circuit 30. An oscillation of the oscillator 32 is sensed to control the control circuit 30 when the walking stick 5 is used. The timer 33 is used to control an operating duration of the control circuit 30.

The control circuit 30 comprises a first conducting member 34, a second conducting member 35, and a third conducting member 36 mounted thereon. The first conducting member 34 is in a U shape and one leg of the first conducting member 34 is axially disposed along an outer periphery of the inner tube 16. The bottom of the first conducting member 34 passes through a bottom of the inner tube 16. The other leg of the first conducting member 34 is axially disposed along the outer periphery of the extendable tube 151 and has a free end extending to a top of the extendable tube 151 for electrically connecting with the power supply 4. The second conducting member 35 is axially disposed along the outer periphery of the inner tube 16 and has one end passing through the lower member 15 via the receiving chamber 12. The third conducting member 36 is disposed on a top of the cover 13 to be electrically connected with the end of the second conducting member 35 and the power supply 4.

The light shade 2 coaxially sleeves on the inner tube 16 and has a gap (not numbered) annularly defined between an inner periphery of the light shade 2 and the outer periphery of the inner tube 16. The light shade 2 has two ends respectively connected with the upper member 14 and the lower member 15. The light shade 2 encloses the light sources 3 and allows light to pass through.

The operation of the illuminating device for a walking stick in accordance with the present invention will be described in detailed below. As shown in FIGS. 1-5, when the optoelectronic device 31 detects the irradiation of the sunlight or the darkness/brightness of the environment, the control circuit 30 is driven to open/close by the optoelectronic device 31. Moreover, the timer 33 is adjusted to control the operating duration of the control circuit 30 in 30 seconds. When the oscillator 32 continuously senses the oscillation of the walking stick 5 during the operating duration, the control circuit 30 keeps open and the light sources 3 are supplied with electricity provided by the power supply 4 to emit light. Light emitted by the light sources 3 is transmitted through the light shade 2 for providing an illuminating effect. When the oscillator 32 does not sense any oscillation of the walking stick 5 during the pre-set operating duration, the control circuit 30 is changed to close and no electricity is provided to the light sources 3.

Although the invention has been explained in relation to its preferred embodiment, it is to be understood that many other possible modifications and variations can be made without departing from the spirit and scope of the invention as hereinafter claimed.

What is claimed is:

1. An illuminating device for a walking stick comprising:

a main body having a through hole defined in a top thereof for adapting to receive a bottom of a walking stick, such that the main body adapts to position on the walking stick; the main body further comprising an upper member, a lower member, and an inner tube having two ends respectively connected with the upper member and the lower member, the lower member having a wear-resisting sleeve annularly disposed on an outer periphery thereof;

a plurality of light source mounted on the main body for emitting light;

a light shade sleeving on the main body and enclosing the light sources, the light shade allowing light to pass through; and a power supply mounted in the main body and electrically connected with the light sources;

wherein the light sources are supplied with electricity provided by the power supply to emit light, and light emitted by the light sources is transmitted through the light shade for providing an illuminating effect.

2. The illuminating device for a walking stick as claimed in claim 1, wherein the main body has a receiving chamber defined in a bottom thereof, the power supply partially received in the receiving chamber, a cover disposed in the bottom of the main body for sealingly covering the receiving chamber.

3. The illuminating device for a walking stick as claimed in claim 1, wherein the light shade having two ends respectively connected with the upper member and the lower member, the light shade coaxially sleeving on the inner tube, the through hole axially defining in the upper member and the receiving chamber axially defining in the lower member.

4. The illuminating device for a walking stick as claimed in claim 1, wherein the main body comprises a control circuit electrically connected with the power supply and the light sources, the control circuit comprising an optoelectronic device mounted thereon, such that the optoelectronic device adapts to detect a darkness/brightness in an environment to open/close the control circuit.

5. The illuminating device for a walking stick as claimed in claim 4, wherein the control circuit comprises an oscillator mounted thereon, such that an oscillation of the oscillator is sensed to control the control circuit when the walking stick is used.

6. The illuminating device for a walking stick as claimed in claim 4, wherein the control circuit comprises a timer mounted thereon for controlling an operating duration of the control circuit.

7. The illuminating device for a walking stick as claimed in claim 4, wherein the control circuit comprises a first conducting member, a second conducting member, and a third conducting member mounted thereon, the second conducting member electrically connected with the third conducting member, the first conducting member and the third conducting member electrically connected with the power supply.

* * * * *